United States Patent [19]

Siffroi et al.

[11] Patent Number: 4,472,698

[45] Date of Patent: Sep. 18, 1984

[54] DEVICE FOR RELEASING THE MOVABLE CONTACTS OF CONTACTORS ADAPTED FOR LIMITING SHORT CIRCUIT CURRENTS

[75] Inventors: Lucien Siffroi, Versailles; Elie Belbel, Vaucresson; André Haury, Le Raincy; Michel Lauraire, Courvevoie; Christian Blanchard, Nanterre, all of France

[73] Assignee: La Telemecanique Electrique, France

[21] Appl. No.: 407,518

[22] Filed: Aug. 12, 1982

[30] Foreign Application Priority Data

Aug. 12, 1981 [FR] France ..... 81 15606

[51] Int. Cl.[3] ..... H01H 77/10

[52] U.S. Cl. ..... 335/195; 335/166; 335/171; 200/291

[58] Field of Search ..... 335/16, 195, 147, 168, 335/171, 189, 166, 167, 255, 256; 337/66; 200/291; 74/527

[56] References Cited

U.S. PATENT DOCUMENTS

| | | | |
|---|---|---|---|
| 3,209,102 | 9/1965 | Boley | 335/171 |
| 3,990,028 | 11/1976 | Aust et al. | 337/66 |
| 4,317,094 | 2/1983 | Peterson | 335/166 |

*Primary Examiner*—Joseph W. Hartary
*Assistant Examiner*—George Andrews
*Attorney, Agent, or Firm*—William A. Drucker

[57] ABSTRACT

A threshold coupling device for releasing the mobile contacts of circuit breakers when short circuits appear. A rectangular section blade (13) with longitudinal faces (13', 13'') associated with a contact holder (10) is provided with balls (29, 30) which cooperate with a resilient clip (33) for providing a threshold mechanical connection between the contact (6) and an operating member (1, 2) which carries this clip. This coupling is advantageously used in circuit-breaker limiters.

11 Claims, 13 Drawing Figures

DEVICE FOR RELEASING THE MOVABLE CONTACTS OF CONTACTORS ADAPTED FOR LIMITING SHORT CIRCUIT CURRENTS

BACKGROUND OF THE INVENTION

The invention relates to a device for automatically releasing the mobile contacts of a cut-off apparatus adapted for breaking a circuit under load such as a contractor adapted for limiting short circuit currents and more to such devices which make use of the electro-dynamic repulsion forces which appear between conductors when a current is flowing therethrough. In such a device, a mobile contact holder has a longitudinal coupling piece which is integral with a contact bridge subjected to these repulsion forces and which is connected to an operating member through a threshold coupling. The threshold coupling comprises convex-shaped members which cooperate transversely with respect to the longitudinal axis and resiliently with notches for providing a predetermined longitudinal holding force between the bridge and the operating member.

THE PRIOR ART

In a known device, of the type above refered to guidance of the longitudinal coupling piece is in the form of a sleeve sliding around and along the operating member and is guided. It results that the coupling member has large transversal dimensions relative to the useful length of the electric conductors which are to generate electrodynamic repulsion forces.

Furthermore, the device is placed on the side opposite the working space of the operating member with respect to the contacts and occupies a large volume which encroaches on the volume of the arc chutes usually associated with the conductors.

In another known device, means are used for guiding the contact holder which are bulky, for the operating member must also here provide guiding of the coupling piece; although the coupling piece is here placed more favourably, it uses several compression springs which take up a large volume because of their lateral arrangement; furthermore, no special precaution has been taken for guaranteeing good insulation.

OBJECT OF THE INVENTION

It is an object of the invention to provide a contact release device whose general construction corresponds to the one mentioned above but in which measures are taken for reducing the volume of threshold coupling and improving the reliability, sensitivity and rapidity.

SUMMARY OF THE INVENTION

A contact release device is provided having a coupling piece formed by a rectangular section metal blade having at one end opposite the contacts a tubular cage with transverse axis in which two balls are loosely housed one bearing on the other and having spherical surface portions outside the cage, and an operating member which comprises a housing in which an elastic clip is placed comprising two pivoting levers placed substantially parallel to the parallel faces of the blade and on each side thereof, each of the two first legs of these levers being provided with an opening or notch placed opposite a ball surface portion, whereas two second opposite legs of these levers placed opposite each other are subjected to opposite forces developed by the same compression spring with transverse axis.

DESCRIPTION OF THE PREFERRED EMBODIMENT

Figure 1:
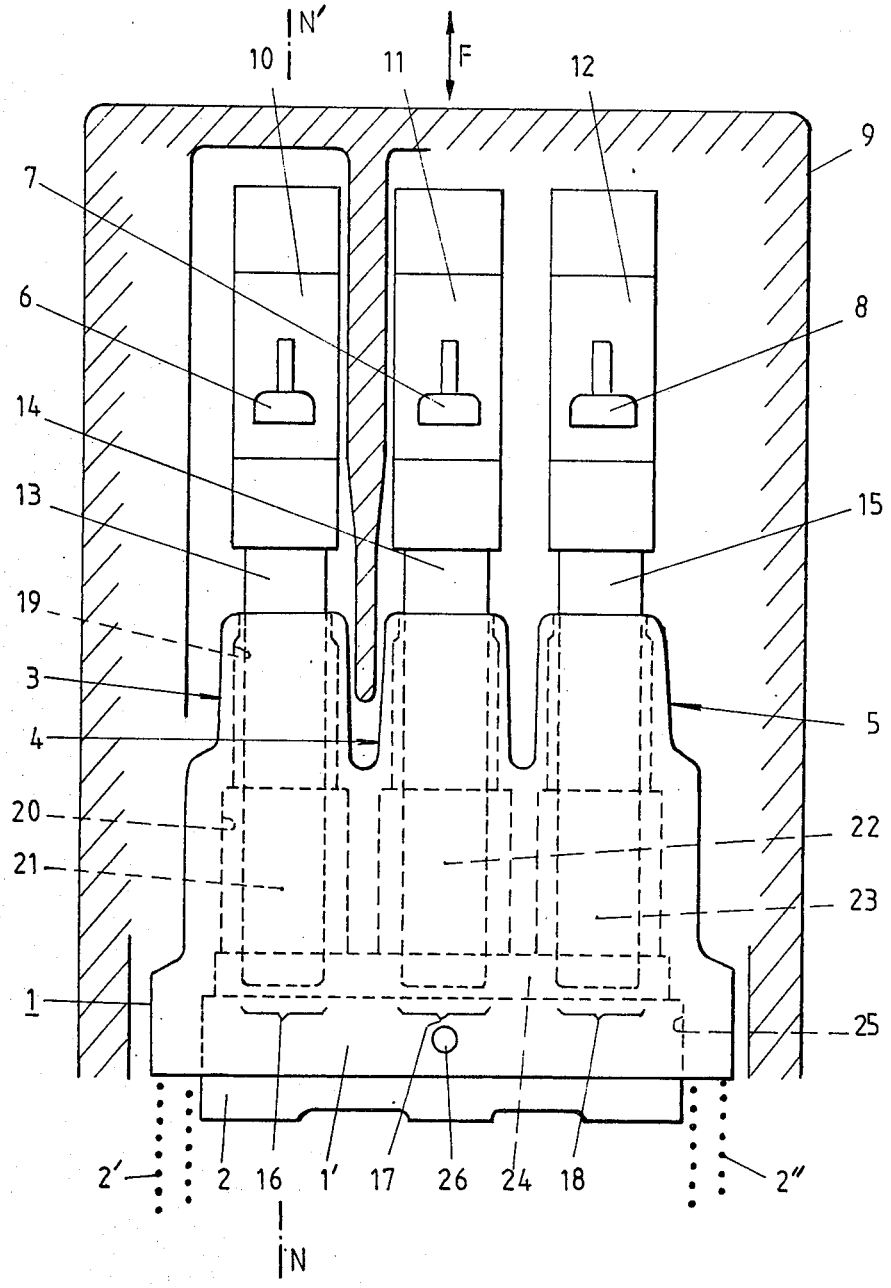
FIG. 1 is a partial sectional view, taken along line SS' of FIG. 3, of a contactor apparatus provided with a contact release device constructed in accordance with the principles of the invention.

A device for actuating mobile contacts 6–7–8 of an apparatus constructed in accordance with the principles of the invention and shown more particularly in FIG. 1 comprises a rake 1 which is the operating member for the mobile contacts and, for example, when it forms an integral part of a contactor adapted for limiting short circuits, a mobile armature 2 belonging to an electromagnet, not shown, which operates the contacts. Such a rake could be controlled by other means, such as a mechanical lock with automatic opening should an overload occur, or possibly with manual control, if the rake controls the contacts of a circuit breaker.

The lower regions 1' of this rake and of this armature are associated for example through a pin 26 placed transversely with respect to the longitudinal direction of movement F of the armature, lateral guiding being provided by means not shown.

This rake comprises three identical hollow portions or columns 3–4–5 connected together in a lower region 1' and each associated with one of the contact systems providing cut-off for each of the phases of a multiphase supply line.

Each mobile contact 6–7–8 formed preferably by a contact bridge, cooperating with two fixed contacts not shown, is placed in a particular contact holder 10–11–12 which is guided in the case 9 of the apparatus by means not shown in detail, which provide axial sliding thereof in direction F. These contact holders 10–11–12 are situated at the top of the figure and comprise respective coupling pieces 13–14–15 which are directed towards the bottom of the figure and which respectively penetrate into the three hollow portions 3–4–5.

Figure 2:
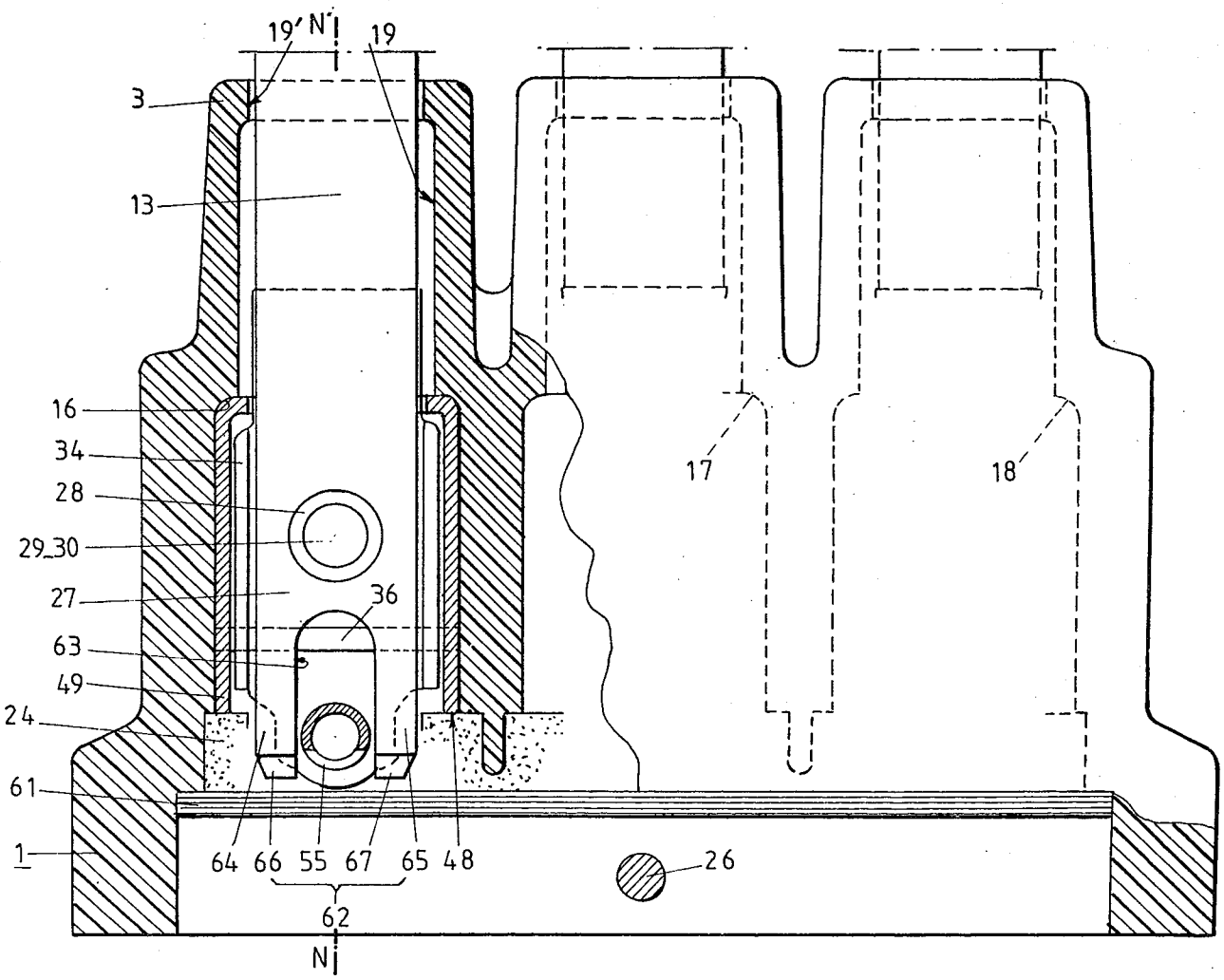
FIG. 2 is an elevational view, partially in section taken along line SS' of a rack adapted to house the contact release device of FIG. 1.
Figure 3:
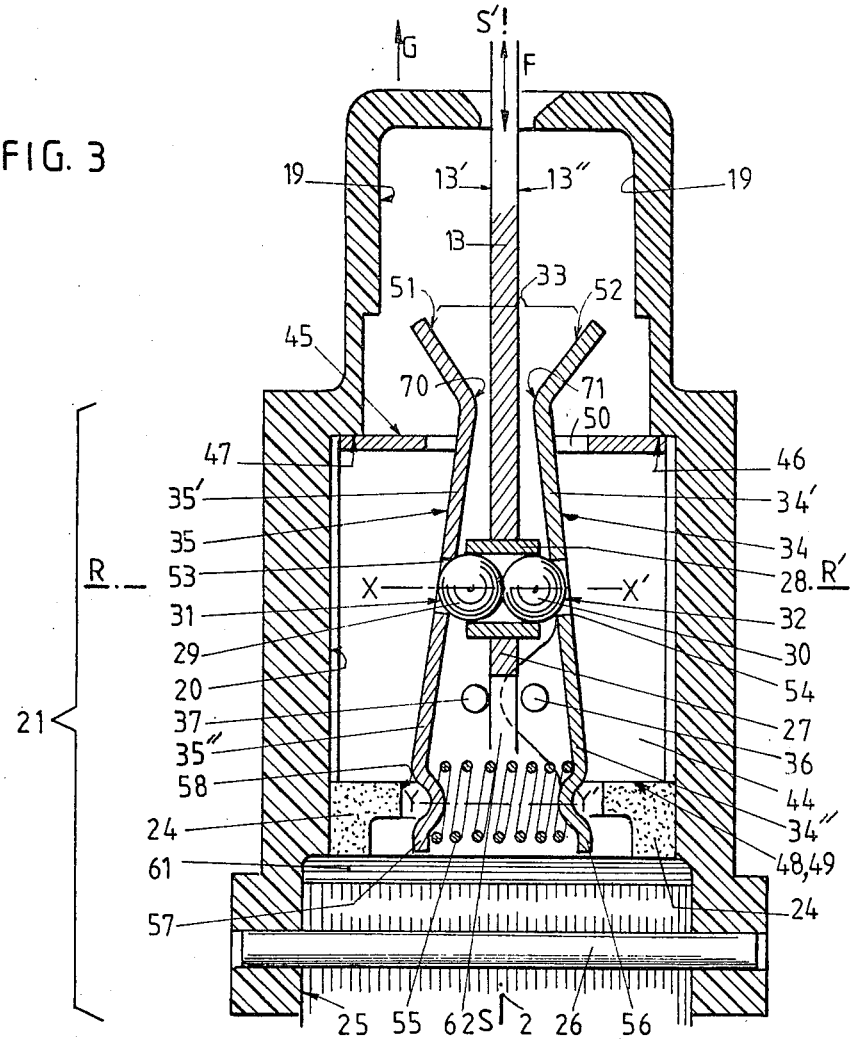
FIG. 3 is a side view of the said contact release device, in section through a plane NN' perpendicular to SS'.

A more detailed view of rake 1 given in FIGS. 2 and 3, shows that each column comprises its own housing, respectively 16, 17, 18 adapted to receive coupling devices 21–22–23 cooperating with the coupling pieces 13–14–15.

Each housing such as 16 is formed of an upper volume such as 19 open at 19' at the top of column 3 and a lower volume such as 20, the coupling devices 21–22–23 being disposed respectively in the respective lower volumes for cooperation with the corresponding coupling pieces ; a lid 24 closes the lower volumes of the housing such as 20 which each open into the same chamber 25, open downwards in the figure and receiving for example the armature 2 and pin 26.

Figure 4:
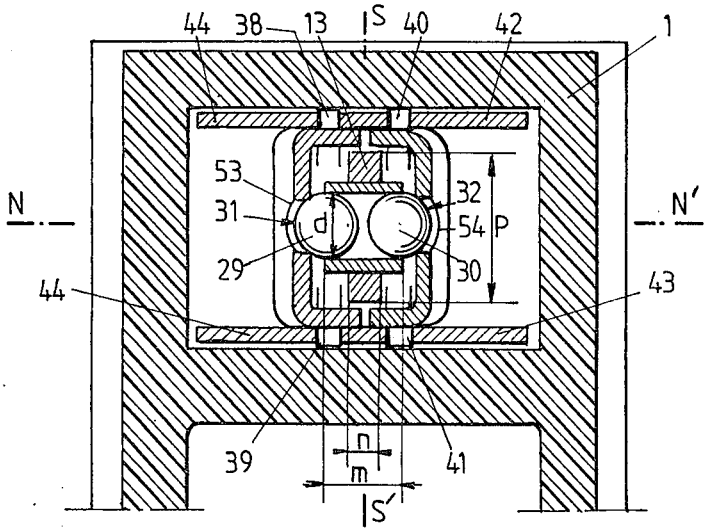
FIG. 4 is a top view of the said contact release device in section through a plane RR' passing through the cage which it comprises.

A coupling device, which is more especially shown in FIGS. 3 and 4, is intended to open to release the coupling piece which is associated therewith and thus allow the corresponding mobile contact to be rapidly expelled upwardly of the figure when the electrodynamic forces to which it is subjected exceed a certain threshold, so as to limit the intensity of the currents which flow in the contact bridge, and consequently, in the supply line concerned. The lower end 27 of a blade 13 which forms a coupling member shown in FIGS. 1, 2 and 3 and which is opposite contact 6 and contact holder 10, has a tubular cage 28 with transverse axis XX' with respect to F, in which are loosely disposed two balls 29–30 so that when the balls are in contact with each other opposite parts of their respective spherical surface, 31, 32, are placed outside the cage; the cage 28 itself has a length m greater than the thickness n of this blade and an inner diameter which allows the balls to roll and move transversely (see FIG. 4) ; this blade 13 has a rectangular section, with parallel faces 13'–13'', the second dimension p of its section being several times greater than its thickness n. It will be noted that the three blades 13–14–15 have their largest faces 13'–13'' parallel to a plane SS' passing through the three portions 3–4–5 of the rake, which further improves the space filling when the device is used in a multiphase circuit breaker.

The coupling device 21 placed in housing 20 comprises a clip 33 formed by two opposite pivoting levers, 34, 35, which are placed substantially parallel to the plane SS'' and which rock about respective transverse pivots 36–37 placed parallel to each other and to the plane SS' and perpendicularly to F. Furthermore, these pivots are fixed by their respective ends, 38–39, 40–41, in two opposite parallel walls 42–43 of a prismatic cage 44 formed by a metal sheet bent in a U shape whose bottom 45, common to both walls, bears on the flanges 46–47 of the lower volume 20, which limit this latter with respect to the upper volume 19, whereas the external edges 48–49 of these walls turned towards chamber 25 bear on lid 24.

The bottom 45 of this cage 44 has further an opening 50 through which pass blade 13 and the ends 51–52 of the clip. On the respective sides of pivots 36–37 are arranged two first lever portions 34'–35' and two second lever portions 34''–35'', the first ones being turned towards the upper volume 19 and the second towards chamber 25, The width of these levers is slightly less than the inner distance separating two walls of the cage so as to allow them to rock about the pivots.

The first lever portions 34'–35' have first facing ends 51–52 which are bent divergently and each comprise between the first end and the pivot an opening or notch 53–54, having for example a circular contour, whereas the second facing lever portions are subjected to opposite forces developed by the same compression spring 55 with transverse axis YY', which bears on the respective second ends 56–57 opposite the first ends to urge the first ends 51–52 together.

When blade 13 is engaged deeply enough in the clip, the surfaces 31–32 of the balls are engaged in openings 53–54 and cause this blade to be held longitudinally by the coupling device 21 and so by rake 1 in direction F so that the movements of this latter are faithfully transmitted to the contact holder. In this coupled position, blade 13 passes between the two pivots 36–37 with a small clearance which ensures lateral guidance thereof.

Figure 5:
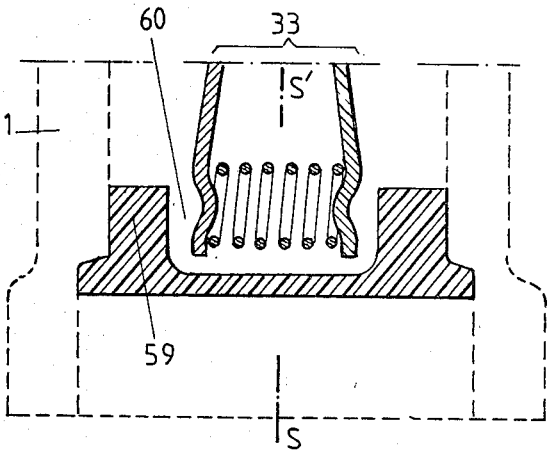
FIG. 5 shows an embodiment of a closure lid for the said contact release device.

In the embodiment shown in FIG. 3, the second ends 56–57 and spring 55 are placed in an opening 58 of lid 24. This space saving arrangement is not limiting, for a thicker lid 59 shown as a modification in FIG. 5 could comprise only a blind recess 60 for receiving these ends.

With reference to FIGS. 2 and 3 it can be seen that an insulating plate 61 or several inulating layers are placed between lid 24 and armatuer 2 so as to provide an adequate insulation between this frame and the metal parts of the coupling unit, which are or which may be at the same potential as the contact bridge.

This insulation is not necessary if a completely closed lid such as 59 is used.

Instead of a single cover 24 several individual covers may be used for closing the volume such as 20 and to hold each of the clip devices 22–21–23.

In the coupling position shown in FIG. 2, it will be further noted that lower end 62 of blade 13 is provided with a longitudinal slot 63 forming two arms respectively located on the respective sides of spring 55. The arms 64–65 have at their tips inclined ramps 66–67 which facilitate introduction of the blade into the clip. The manner in which the blade 13 is guided, on the one hand between pivots 36–37 and on the other hand between openings 53–54 along the balls endows this coupling device with the possibility of tolerating slight angular misalignments between the longitudinal axis of the blade and the axis of the corresponding column. The opposite forces applied to the balls in direction XX', due to the force developed by spring 55, as well as the penetration of the balls into the notches or openings 53–54 in position I, cause clip 33 to hold blade 13 in direction F.

For a particular arrangement of the balls and the notches, these forces may be overcome when a given pull in direction G is applied to blade 13, and when the clip 33 is held in position, for example when armatuer 2 is attracted against the yoke of the electromagnet.

Figure 6:
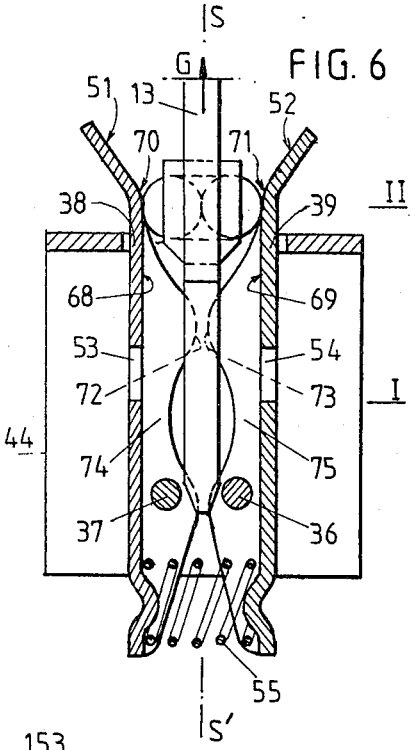
FIG. 6 illustrates a diagrammatical view, in section along NN' of the said contact release device after trip-out thereof.

When, following application to the blade of a force coming from the electrodynamic repulsion communicated in direction G to the contact bridge, which is greater than a given threshold, the coupling has been opened, blade 13 is placed in a position II shown in FIG. 6, which corresponds to the position in which the contact bridge has been expelled. In this position, surfaces 31–32 of the two balls 29–30 are on the one hand positioned against two flat internal surfaces 68–69 of the levers which are substantially parallel and, on the other hand, in the vicinity of the edges 70–71 which define the origin of the bent ends 51–52.

Stops 72–73, placed facing each other and carried by stiffening flanges, 74, 75, of the levers, bent at right angles with respect to the surfaces 68–69, limit the closing up movement of the ends 51–52 when the blade is not engaged in the clip, as happens at the time of assembling the apparatus.

The balls cannot then fall in this position and a new coupling position may be obtained by causing a relative closing up movement in the direction opposite to G between the blade and the clip during which the balls roll first of all over surfaces 68–69, then click into openings 53–54.

Because of the parallelism of surfaces 68–69, the coupling procedure between blade 13 and clip 33 occurs practically without any resistant force appearing in the direction opposite G.

However, the two pivots can be spaced apart in such a way that, in the uncoupled position, the two surfaces 68–69 will converge slightly towards a common line placed in the plane SS'.

If this line of convergence of the two surfaces were placed above the pivots, blade 13 would tend to be urged towards the pivots, which would be advantageous for example for establishing a new coupling which would be obtained automatically by a movement of the armature towards the top of the figure, in direction G, under the effect of springs 2'–2'' returning this latter to the rest position, see also FIG. 1.

If on the contrary, the line of convergence of surfaces 68–69 were placed below the pivots, plate 13 would tend to be pushed back in direction G, which would be advantageous for stabilizing the contact holder, into an opening position while damping the possible effects of its impact at the top of the box during a trip-out.

Figure 7:
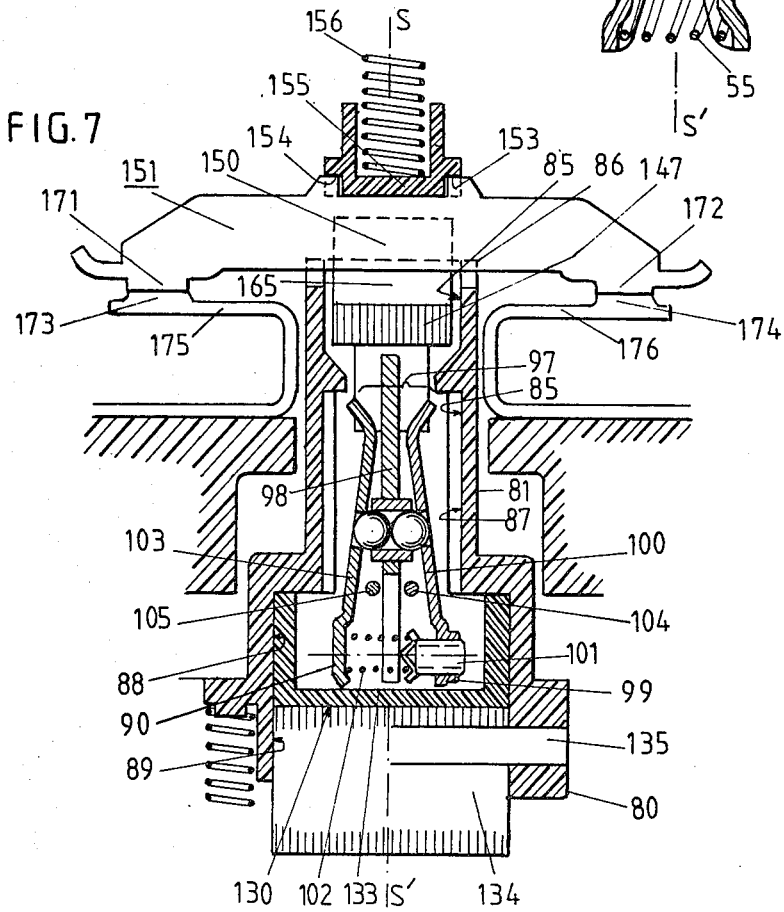
FIG. 7 is a side view, in section through the plane NN' of embodiment of the operating member of a contact release device such as shown in FIG. 10.
Figure 10:
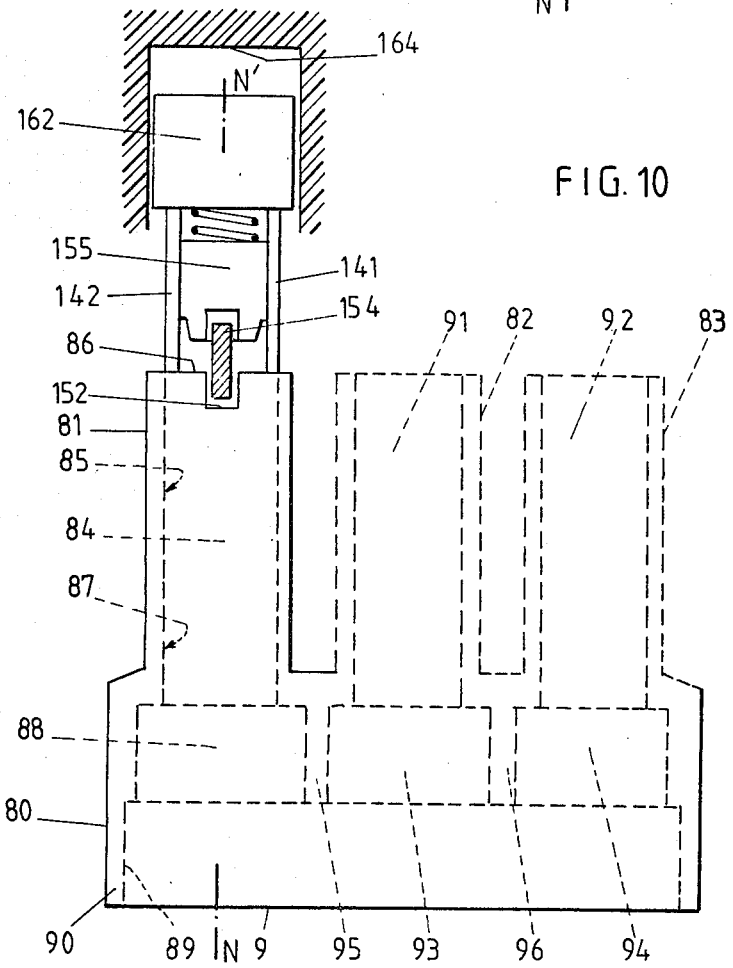
FIG. 10 shows an elevational view of another embodiment of the operating member, FIGS. 11 and 12 respectively are a sectional elevation and in a side view of a contact holder equipped with a coupling piece.

The embodiment of the clip and the blade which has just been described may be used in a switch apparatus having the same general structure, but of different shapes such as can be seen in FIGS. 7 and 10.

The multiphase apparatus of FIGS. 7 and 10 still comprises a rake, or operating member 80, which also comprises several hollow columns 81–82–83 placed in parallel.

Figure 9:
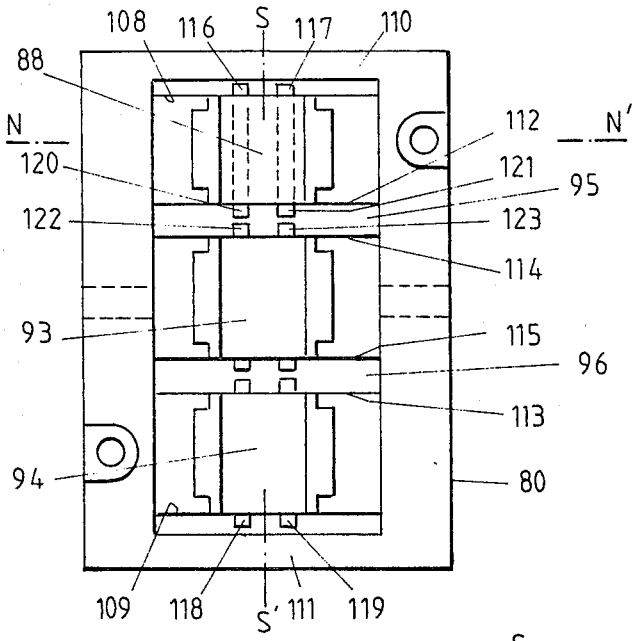
FIG. 9 is a bottom view of the said operating member without its coupling devices.

A column such as 81 has an internal bore 84 comprising an upper space 85 which opens at 86 at the upper end of this column, an intermediate space 87 and a lower space 88 which opens into a chamber 89, common to several column bores 84–91–92, see FIG. 10; the adjacent lower spaces 88–93–94 of the three columns are separated by insulating walls 95–96 which stop at the level of the lower space, see also FIG. 9.

A clip 97 similar to clip 33 is housed in the intermediate space 87 for cooperation with a rectangular blade 98 which is identical to blade 13 and which passes through the column.

The only modification in this clip resides here in the provision, between the ends 99–90 of levers 100–103 of clip 97, of an adjusting screw 101 for adjusting the tension of the common spring 102 through a displacement along axis YY', for adjusting the threshold coupling opening threshold.

Figure 8:
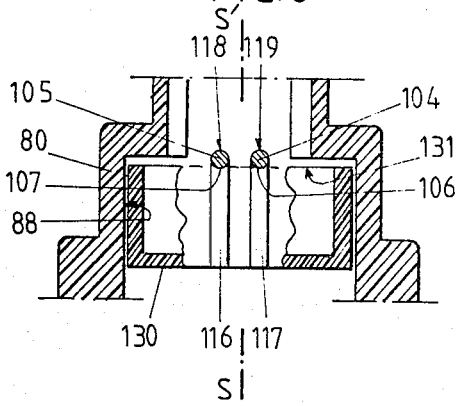
FIG. 8 illustrates in section through NN a part of the said operating member without its coupling clip and with the lid partially cut away.
Figure 13:
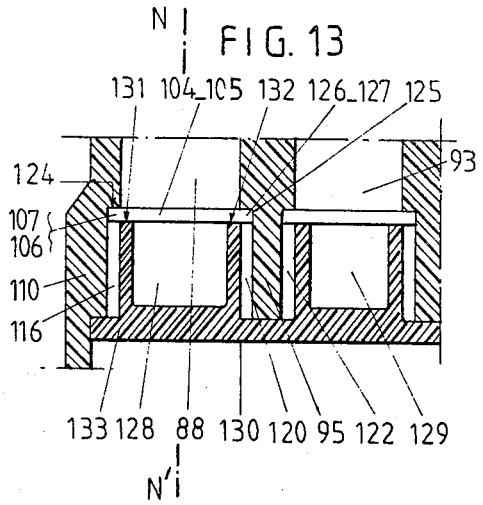
FIG. 13 is a partial view in elevation and in section through plane SS' of the operating member of FIG. 10, equipped with pivots and a lid.

The two clip levers 100–103 here again pivot on two parallel pivots 104–105 whose ends, such as 106–107 see FIGS. 8 and 13, are fixed differently than in the preceding embodiment.

Each of the lower spaces 88, 94 and 93 comprises, on internal surfaces 108, 109 of lateral walls 110, 111 of the rake, as well as on internal surfaces 112, 113 and 114, 115 of the partition walls 95–96, pairs of parallel grooves such as 116–117, 118–119, 120–121 and 122–123, see FIGS. 8, 13 and 9.

These grooves which extend parallel to the axis F of a column terminate at the limit of the corresponding intermediate space, for example at 124–125 for space 88, so as to receive the ends, 106, 107 and 126, 127 of pivots 104–103.

A common insulating cover 130 has in each lower space a prismatic chamber such as 128 or 129 whose opposite walls parallel to the axis of the bore support by their upper edges, such as 131–132, see FIG. 13, the ends of the pivots. The solid bottom 133 of this insulating cover 130 serves, as in the preceding embodiment, for insulating each coupling device, from an electromagnet armature 134 which is held in chamber 89 by means of a pin 135.

Figure 11:
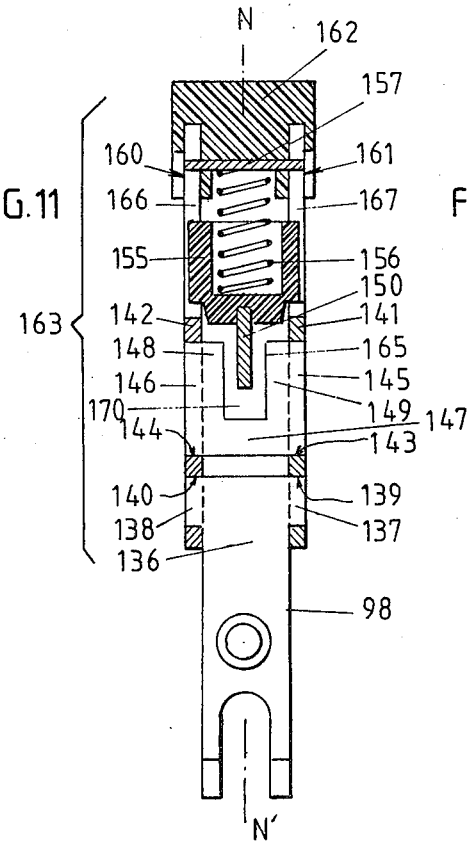
Figure 12:
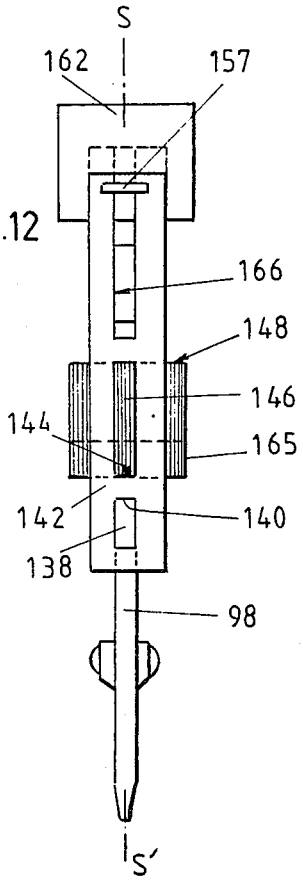

In one embodiment of contact holder 163 shown in FIGS. 7, 11 and 12, the coupling blade 98 comprises at its upper part 136 two lateral logs 138–137 which penetrate into openings 139–140 of two parallel metal uprights 141–142 to which these logs are secured.

These uprights have two other openings 143, 144, which are placed above the preceding ones and in the same median plane SS' for holding in position a U-shaped magnetic piece 165 having a cross piece 147 placed in the vicinity of 136, two parallel legs 148–149 whose external portions 145–146 penetrate into openings 143–144 and a slit 170 placed in a plane NN' perpendicular to SS'.

Upper ends 160–161 of the uprights are connected together by a coupling piece 162 made from plastic material and by a transverse key 157, this piece 162 serving advantageously for the upper guiding of the contact holder and as a stop means against an upper stop surface 164 of the case of the apparatus which will define for example position II.

Between these upper ends 160–161 and openings 143–144 there are placed, in the same plane SS', two parallel longitudinal grooves 166–167 which guide a contact pusher 155 urged to the bottom of the figure by a contact pressure spring 156. This pusher bears axially on the upper edge of the central region 150 of a contact bridge 151, see FIG. 7, and holds it transversely in position through notches 153–154.

The contact inserts 171–172 of bridge 151 are applied to the fixed contacts 173–174 carried in a known way by conductors 175–176 extending partly in parallel to the contact bridge.

The central region 150 is placed in the slit 170 of the magnetic piece 165 so as to cooperate therewith electromagnetically when the contact bridge 151 has large currents flowing therethrough.

These currents, which are very much less than those which cause repulsion forces to appear on the contact bridge in direction G, cause attraction of the contact bridge by the magnetic piece in the opposite direction to G.

In the embodiments illustrated, the blades such as 13 have a flat rectangular section which allows the mass of a contact holder to be made as light as possible so that expulsion thereof by the repulsion forces is extremely rapid and so that thereby the limitation of the currents which caused it is efficient ; it is clear that the use of a blade having a different section, for example square or round, would lead to an increase in the mass of the contact holder and so a deterioration of the performances thereof without for all that departing from the scope of the invention.

The contact releasing device which has been illustrated in a case where it is used in a contactor further adapted for limiting short circuit currents may be advantageously applied to a circuit breaker-limiter having instead of an electromagnet a mechanical means for automatically controlling the rake which free this latter when overcurrents appear, these mechanical means being set and reset by manual control.

In such circuit breaker-limiter apparatus a small rake could be used for each of the phases which would comprise a single release device capable of operating independently of the others.

A contact release device may also be used comprising a clip system such as previously described but fixed in a case, and a coupling blade integral with a contact holder when it is desired to form a repulsion switch-limiter stage which may be further associated with an appropriate contactor.

When the contact release device associated with a contactor is required to be reset automatically, this resetting is provided by the movement of the armature which under the effect of its own return springs causes the notches of the clips to be again engaged on the balls, the contact holder being then placed in abutment against an upper surface of the case which provides simultaneously and through appropriate means damping of the movement of the contact holder and holding thereof in a high position.

If the contact device is required to be reset manually, a movement of the rake may be provided mechanically which is equivalent to that communicated by the abovedescribed contactor armature (for example in the case of a circuit breaker), or an opening may be provided at the top of the case through which manual external means may act in the direction opposite G on the upper end of the contact holder, such as piece 162 (for example in the case of a switch-limiter stage).

We claim:

1. A switching apparatus having stationary and movable contacts, support means for the movable contacts, operating means to open and close the contacts and means removably connecting the operating means to the support means, the said support means including an elongated metal blade and being so arranged that a pulling force is exerted on the metal blade at a first end thereof when a current flows through the contacts, and the coupling means comprising:

a tubular cage mounted across said blade at an opposite second end of said blade and substantially at right angles with said blade;

first and second mutually engaging balls partially housed in said tubular cage, with spherical surface portions thereof projecting out of said cage;

first and second elongated resilient levers respectively located on the respective sides of said blade in general directions which are substantially parallel to said blade, said first and second levers having first and second respective flange means which are substantially parallel to the blade and located on the respective sides of the blade, said first and second levers each having first and second end portions, the first end portions of the levers being located nearer from the said first end of the blade than the second end portions of the levers and, the first and second levers respectively having first and second openings which are adapted to receive the projecting out surface portions of the first and second respective balls;

means for securing the said flange means to the operating means;

and compression spring means biasing said first and second levers located between the respective second end portions of the levers, substantially at right angles to the blade.

2. A switching apparatus as claimed in claim 1, wherein the said means for securing the flange means include a U-shaped metal cage having two substantially parallel side walls and a bottom wall, each flange means having two ends mounted in the respective side walls and in the bottom wall having an opening through which pass the first end portions of the levers.

3. A switching apparatus as claimed in claim 1, wherein the first end portions of the levers diverge in the direction of the first end of the blade.

4. A switching apparatus as claimed in claim 1, wherein when the said projecting out surface portions of the balls are engaged in the said openings of the levers, the second end of the blade is in close proximity to the said spring means.

5. A switching apparatus as claimed in claim 1, wherein said spring means consists of a spring and a screw coaxially mounted with the spring for adjusting the compression of the said spring.

6. A switching apparatus as claimed in claim 3, wherein, when the said projecting out surface portions of the balls are disengaged from the said openings of the levers, the said surface portions are engaging plane surface portions of the respective levers which are adjacent to the said diverging first end portions.

7. A switching apparatus as claimed in claim 2, wherein the said operating means has a housing having first and second volume portions with an insulating wall between said volume portions and an electromagnet armature within the second volume portion and within the first volume portion, the said U-shaped metal cage and cover means supporting the side walls of the said U-shaped metal cage.

8. A multiphase switching apparatus as claimed in claim 1, said apparatus having a plurality of stationary and movable contact sets, a corresponding plurality of support means for the movable contacts of the respective sets, a plurality of operating means and a corresponding plurality of coupling means for removably connecting the said operating means to the respective support means, each of said coupling means including an elongated metal blade of rectangular cross-section and being so arranged that a pulling force is exerted on the metal blade at a first end thereof when a current flows through the contacts of the respective contact set and each of the coupling means comprising:

a tubular cage mounted across said blade at an opposite second end of said blade and substantially at right angles with said blade;

first said second mutually engaging balls partially housed in said tubular cage, with spherical surface portions thereof projecting out of said cage;

first and second elongated resilient levers respectively located on the respective sides of said blade in general directions which are substantially parallel to said blade, said first and second levers having first and second respective flange means which are substantially parallel to the blade and located on the respective sides of the blade, said first and second levers each having first and second end portions, the end portions of the levers being located nearer from the said first end of the blade than the second end portions of the levers and, the first and second levers respectively having first and second openings which are adapted to receive the projecting out surface portions of the first and second respective balls;

means for securing the said flange means to the operating means;

and compression spring means located between the respective second end portions of the levers, substantially at right angles to the blade, said common operating means including rake means forming a plurality of parallel hollow columns in which the respective coupling means are respectively housed in the respective hollow columns with the metal blades of the respective coupling means having parallel positions.

9. A switching apparatus as claimed in claim 1, wherein the said support means for the movable contacts include a contact bridge; two parallel metal uprights are mounted on the respective edges of the blade at the first end thereof; a U-shaped magnetizable member with two legs defining a slot there between and a cross member has the said legs respectively secured to the respective uprights and the said crossmember located nearer the second end of the blade than the said slot, the said contact bridge has a central portion movably mounted within the said slot and pusher means slidably mounted between the said uprights cooperating with the said central portion.

10. A switching apparatus as claimed in claim 1, wherein the operating means has first and second volume portions, an electromagnet armature being lodged within the second volume portion, said first volume portion having an end portion which comprises first and second opposite side walls forming a chamber, an insulating cover removably mounted in said chamber, said cover having first and second opposite side walls and a bottom wall, first and second pairs of grooves respectively formed in the first and second opposite side walls of the said end portion, said grooves being substantially parallel to the blade, the said flange means each having first and second ends which are respectively engaged into the first and second grooves, the first and second opposite side walls of the said cover being engaged into the said chamber along the first and second opposite side walls of the chamber for holding the said ends of the flange means in place.

11. A switching apparatus as claimed in claim 1, wherein the said metal blade has a rectangular cross-section.

* * * * *